US006870312B2

(12) United States Patent
Kymissis et al.

(10) Patent No.: US 6,870,312 B2
(45) Date of Patent: Mar. 22, 2005

(54) ORGANIC FIELD EMISSION DEVICE

(75) Inventors: Ioannis Kymissis, Cambridge, MA (US); Akintunde Ibitayo Akinwande, Newton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 10/284,796

(22) Filed: Oct. 31, 2002

(65) Prior Publication Data

US 2003/0080672 A1 May 1, 2003

Related U.S. Application Data

(60) Provisional application No. 60/336,520, filed on Nov. 1, 2001.

(51) Int. Cl.[7] ..... H01J 63/04

(52) U.S. Cl. ..... 313/495; 313/302; 313/496

(58) Field of Search ..... 313/495–497, 313/293–302; 345/75.2

(56) References Cited

U.S. PATENT DOCUMENTS 5,448,132 A * 9/1995 Komatsu ..... 313/495
6,137,219 A * 10/2000 Song et al. ..... 313/497
6,545,291 B1 * 4/2003 Amundson et al. ..... 257/40

FOREIGN PATENT DOCUMENTS

| | | |
|---|---|---|
| EP | 0 399 299 A2 | 11/1990 |
| GB | 2 233 334 A | 1/1991 |
| WO | WO 99/48122 | 9/1999 |

OTHER PUBLICATIONS

I Musa. D.A.I. Munindrasdasa. G.A.J. Amaratunga and W. Eccleston. "Ultra–Low–Threshold Field Emission From Conjugated Polymers." Nature. MacMillan Journals. Ltd.. London. GB. vol. 395. Page(s) 362–3655.

I. Musa. W Eccleston and G A. J. Amaratunga. "Analysis of Low Threshold Field–Emission from Conjugated Polymers for Displays." International Electron Devices Meeting 1998. IEDM Technical Digest. San Francisco. CA. Dec. 6–9. 1998. New York. NY: IEEE. US. Page(s) 867–869.

International Search Report of PCT Application No. PCT/US02/34858 mailed Apr. 3. 2003.

* cited by examiner

*Primary Examiner*—Vip Patel
*Assistant Examiner*—Glenn Zimmerman
(74) *Attorney, Agent, or Firm*—Daly, Crowley & Mofford, LLP

(57) ABSTRACT

A patterned field emission device fabricated using conducting or semiconducting organic materials is described.

9 Claims, 10 Drawing Sheets

ORGANIC FIELD EMISSION DEVICE

CROSS REFERENCE TO RELATED APPLICATIONS

This application claims the benefit of U.S. Provisional Patent Application Ser. No. 60/336,520 entitled "Organic Field Emission Device," filed Nov. 1, 2001, which is incorporated herein by reference in its entirety for all purposes.

BACKGROUND

The invention relates generally to field emission devices.

Field emission devices are used in a number of different applications, including displays, e-beam lithography, chemical analysis and space propulsion. Wide use of field emission devices in these applications, particularly in displays, has been hampered by the complexity of processing field emitting materials and the consequent high cost of such applications. Conventional field emission devices have been fabricated from such field emitting materials as metals, crystalline semiconductors, thin film diamond (diamond-like-carbon), graphite and nanotubes.

Organic conductors and semiconductors have been examined extensively for application in logic circuitry, light emission, and light detection. The application of this class of organic materials has been largely ignored, however, for field emission because of difficulties inherent in processing the materials for this application.

SUMMARY

In one aspect of the invention, a field emission device includes a conductor having a plurality of micro-tips, the micro-tips comprising an organic material.

In another aspect of the invention, a method of fabricating a field emission device includes providing a substrate and patterning on the substrate one or more organic field emitter structures.

In yet another aspect of the invention, a field emission display includes an anode comprising a light emitting material and a cathode coupled to the anode. The cathode includes a substrate and a plurality of organic field emitters disposed on the substrate.

Particular implementations of the invention may provide one or more of the following advantages. Template-based and other room temperature processing of organic materials to form field emission tips results in reduced field emitter manufacturing costs. The gated structure allows for significantly reduced noise, reduced impact of aging and gas exposure, increased uniformity across display panels, and also allows for control of the field emission current with low voltages. Using a transistor instead of a gated electrode (located in close proximity to the emitter micro-tips) reduces process complexity and also eliminates the gate current associated with conventional field emission structures due to recapture of the emission current. Moreover, the inclusion of the transistor in the field emission device reduces the spatial and temporal variations in field emission current as it means the barrier that controls electron emission is moved from the solid/vacuum interface to an internal source/channel junction barrier.

Other features and advantages of the invention will be apparent from the following detailed description and from the claims.

DESCRIPTION OF DRAWINGS

Like reference numerals will be used to represent like elements.

DETAILED DESCRIPTION

Figure 1:
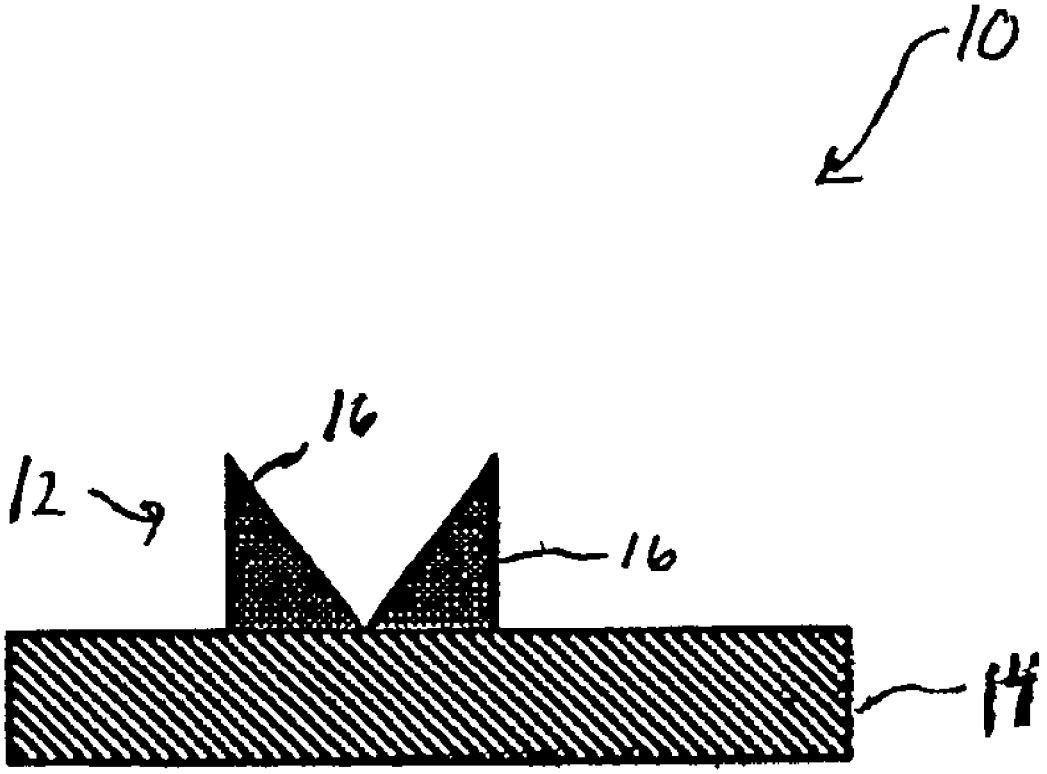
FIG. 1 is a cross-sectional view of an organic field emission device with micro-tips.

Referring to FIG. 1, shown in a cross-sectional view, a field emission device 10 includes a field emitter structure or conductor 12 disposed on a substrate 14. Different materials, for example, glass or silicon, can be used for the substrate 14. The conductor 12 is made of an organic material and includes one or more field emitter micro-tips 16, which will be described in greater detail with reference to FIGS. 2–5.

It will be appreciated that organic conductors and semiconductors are, in general, difficult to process. Interactions between most conducting materials and solvents usually prevent polymers from being soluble, and oligomeric materials are rarely soluble while retaining their unique electronic structure. Various techniques have been developed to reduce such processing difficulties. For example, oligomeric materials may be vacuum deposited using a vacuum sublimation process. Both polymeric and oligomeric materials may be polymerized directly into the desired structure from soluble monomers or oligomers using electropolymerization or other techniques. Also, processable precursors may be deposited and converted to their final form. In addition, soluble end groups may be added to solubilize material without disturbing conductivity. Those materials may be dispersed in a solid solution (or fine dispersion) with another processable polymer and a dopant. It is also known that materials may be processed in an oxidation state which is soluble and converted after deposition.

Figure 2:
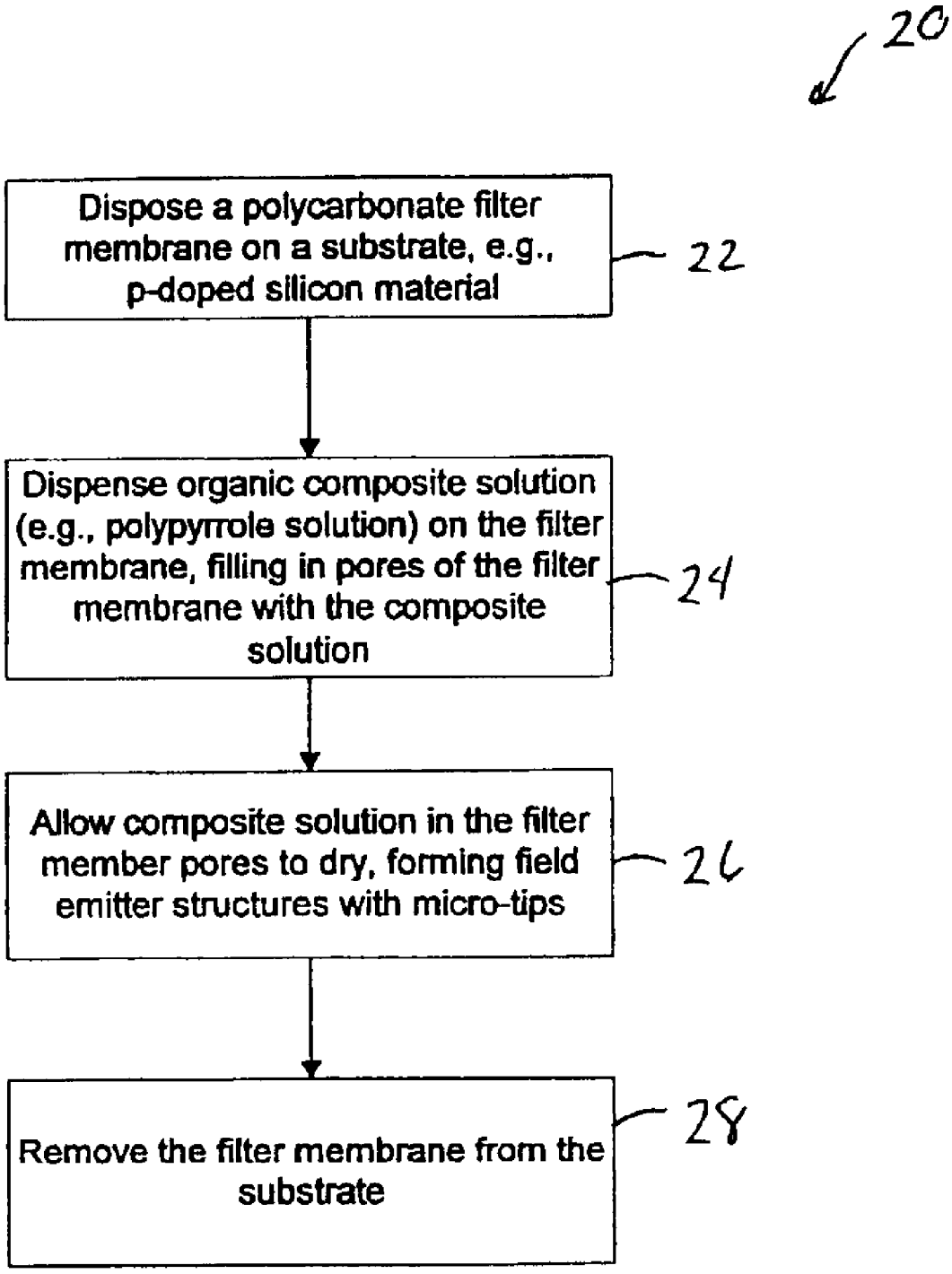
FIG. 2 is a flow diagram of a process for fabricating the organic field emission device shown in FIG. 1.

FIG. 2 shows a method of fabricating the field emission device 10, indicated as process 20. In the illustrated embodiment, process 20 is a solutions-based process. FIGS. 3A–3D show structures formed at various stages of the process 20. Referring to FIG. 2 in conjunction with FIGS. 3A–3D, the process 20 includes processing stages 22, 24, 26 and 28.

Figure 3A:
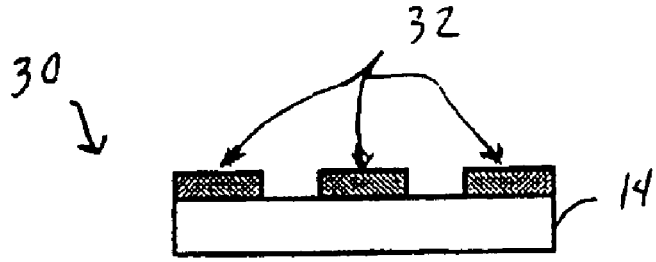
FIGS. 3A–3D are cross-sectional views of structures produced during the processing stages shown in FIG. 2.
Figure 3B:
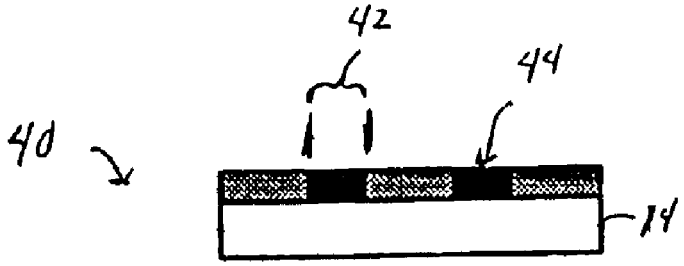
Figure 3C:
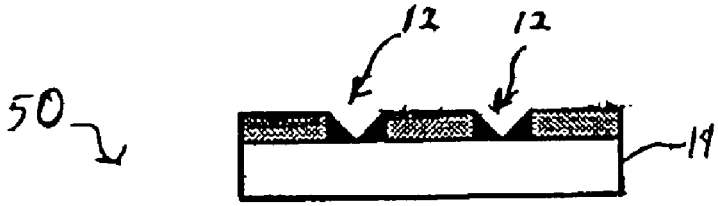

In processing stage 22, a polycarbonate filter membrane is disposed on a substrate. As shown in FIG. 3A, a resulting first structure 30 includes a polycarbonate filter membrane 32 disposed on the substrate 14. The membrane 32 may be a commercially available polycarbonate membrane, e.g., an ion-track etched, 3 micron diameter pore polycarbonate filter membrane (or template) available from Whatman. Preferably, the substrate 14 is heavily doped, p-type cleaned silicon wafer material.

In process stage 24, a solution is dispensed over the membrane 32. More specifically, and also referring to FIG. 3C, the first structure 30 is further processed to produce a second structure 40 by filling pores 42 of the membrane 32 with a polypyrrole (PP) solution 44. The solution can be dispensed in any suitable manner, e.g., using a syringe.

In the illustrated embodiment, the solution can be produced by mixing a solution of doped polypyrrole (e.g., 5% polypyrrole, Sigma-Aldrich product number 482552) and PVA solution in water (2–4%) to form a composite solution with about 50% polypyrrole and 50% PVA dissolved solids. Preferably, the total material composition is 4% PVA, 4% polypyrrole, and 92% water with organic acids. Other material compositions can be used as well. The composite solution can be mixed at room temperature, for example, using a mechanical stirring system. Optionally, prior to spreading the solution on the membrane, the composite solution may be filtered, preferably once with a one micron membrane and twice with a 0.2 micron membrane.

In processing stage 26, once the composite solution 44 is dispensed on the membrane 32 so as to fill the pores 42 of the membrane 32, the solution contained in the pores 42 is dried at room temperature (approximately 25 degrees C.). The attraction between the solution 44 and the membrane 32 produces, in each solution-filled pore, the field emitter structure 12 (from FIG. 1).

Figure 3D:
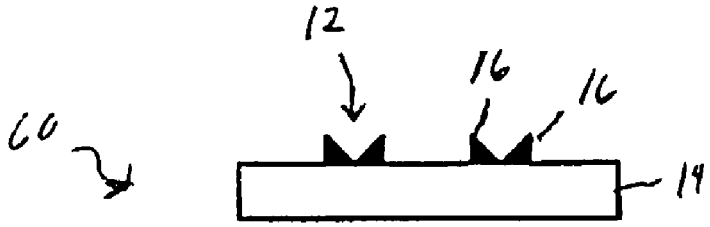

In processing stage 28, and with reference also to FIG. 3D, the membrane 32 is removed or separated from the substrate 14, leaving a final structure 60 that includes multiple field emitter structures (or sites) 12 on the substrate 14. Thus, in this particular embodiment, the field emitter structures 12 are a polyvinyl alcohol/polypyrrole doped conducting composite patterned using the polycarbonate filter template. The field emitter structures 12 produced by this technique have small, sharp tips (the micro-tips 16, from FIG. 1) that can exhibit significant field enhancement and emit electrons in a diode type field emission arrangement.

While only two field emitter structures 12 are shown, it will be understood that the technique can produce a greater number of such structures on a common substrate. It will be appreciated that the number of structures 12 (and therefore micro-tips 16) is a function of the number of the membrane pores in the membrane that is used.

Figure 4A:
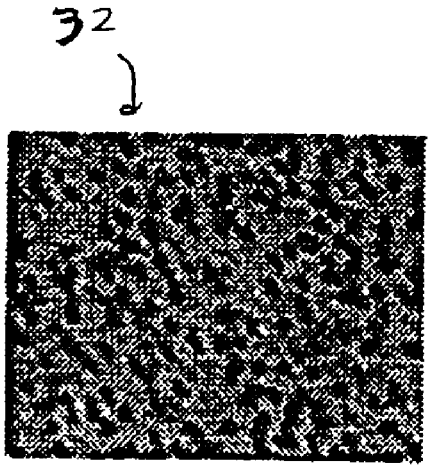
FIGS. 4A and 4B are optical micrographs showing an exemplary polycarbonate template and micro-tips distribution produced using the polycarbonate template, respectively.
Figure 4B:
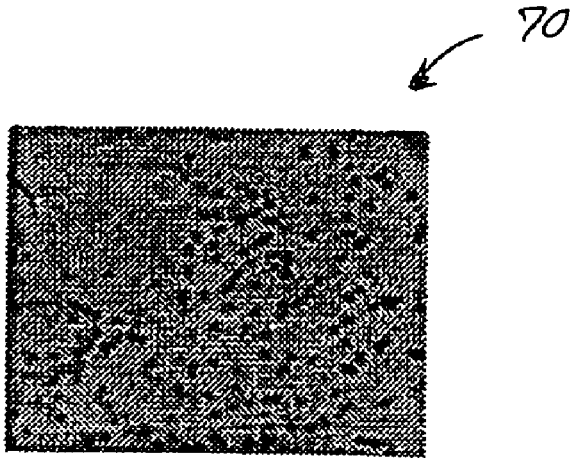

FIG. 4A shows an optical micrograph of an example of the polycarbonate filter template 32 (from process 20). In FIG. 4B, again in an optical micrograph view, a micro-tips distribution 70 of the micro-tips 16 formed by using the exemplary template of FIG. 4A is shown.

Figure 5:
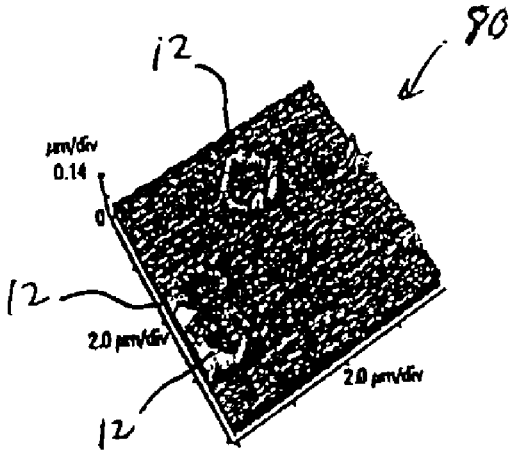
FIG. 5 is an atomic force microscope image of the micro-tips formed using the process shown in FIG. 2.

Referring to FIG. 5, in an atomic force microscope image, an organic field emission device topography 80 of a few structures 12 of the same sample (that is, the sample shown in FIG. 4B) is shown. It may be seen that the structures 12 formed using the solutions-based process 20 have a diameter of approximately three microns and are approximately 0.15 microns tall, with several sharp areas (corresponding to the micro-tips 16) from which field enhancement and electron emission is expected. With the above-described processing techniques, it is possible to achieve micron-sized micro-tips with a radius of approximately 20 nm at their sharpest points. The micro-tips 16 can be fabricated at a micro-tip density of approximately four million tips per square centimeter.

Figure 6:
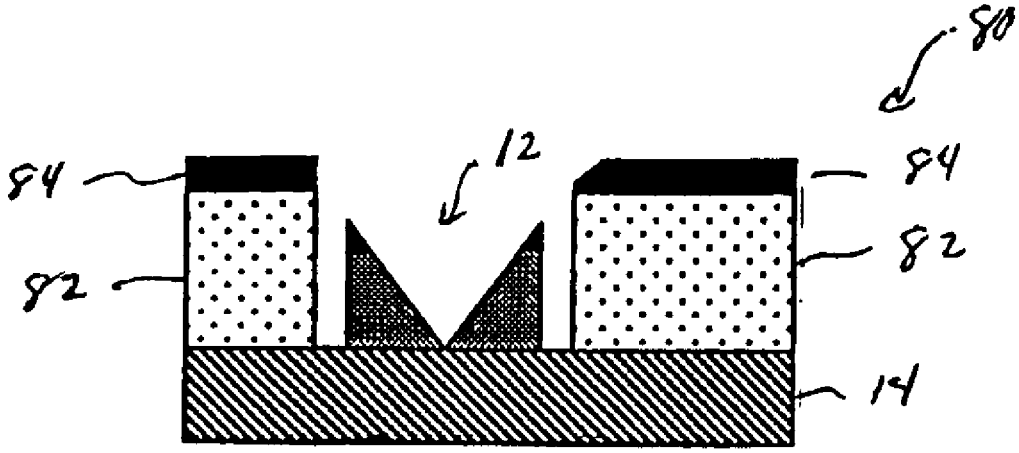
FIG. 6 is a cross-sectional view of a gated (triode) organic field emission device.

In another embodiment, and referring to FIG. 6, the process 20 may be extended to produce a gated organic field emission device 80, that is, the organic field device 10 with a gate surrounding each field emitter structure 12. Thus, beginning with the structure 10 described above (i.e., the substrate 14 and field emitter structures 12, an insulator (or dielectric) material 82 is deposited in a generally conformal manner on the field emitter structure 12 and substrate 14 by spin coating, sputtering, chemical vapor deposition, or other technique. A gate conductor 84 is deposited on the insulator 82. The gate conductor 84 may be patterned by mechanical or chemical-mechanical polishing, and the insulator 82 etched back using a gas or liquid etchant to produce the resulting structure, the gated organic field emission device 80. Gating the field emission device in this manner, by placing an annular gate around the micro-tips to adjust the field at the emitter surface, advantageously allows a low voltage to control the field emission while allowing a single common high voltage source to power the electric field across the micro-tips.

An external grid or lithographically defined deposited electrode may be used to form the triode structure shown in FIG. 6. The ability to include a triode electrode via self aligned or mask patterned techniques represents a significant advantage over unpatterned films for the field emission device application.

Figure 7:
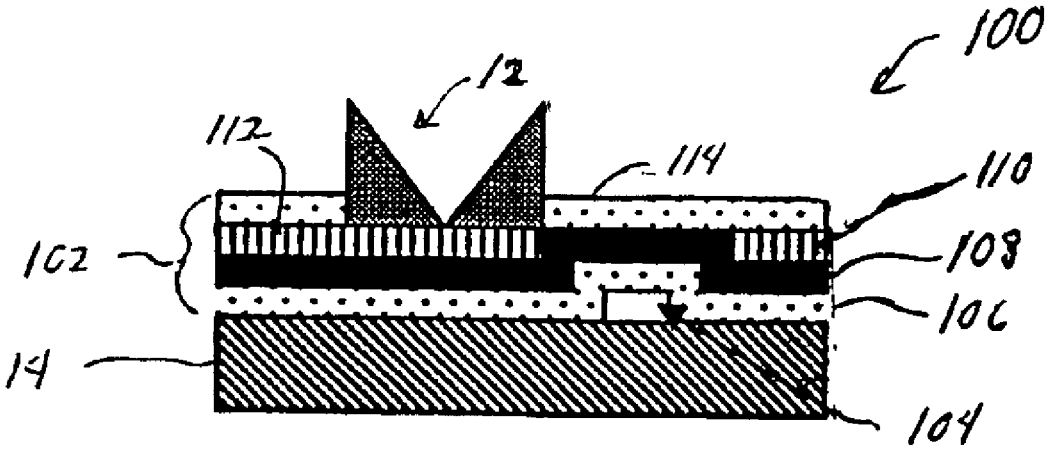
FIG. 7 is a cross-sectional view of an organic field emission device having an integrated transistor.

Referring to FIG. 7, in yet another alternative embodiment, an organic field emission device 100 has a thin film transistor 102 integrated therein. The transistor 102 is formed oh the substrate 14 to include a gate 104 on the substrate 14, a gate dielectric 106 deposited on the gate 104 and substrate 14, a semiconductor layer 108 deposited in the gate dielectric 106, and a source electrode 110 and drain electrode 112 formed in the semiconductor layer 108. On top of the transistor 102, in particular, the drain 112, the field emitter structure 12 is formed. Thus, the drain 112 serves as a field emitter structure contact. An insulative layer 114 covers exposed surfaces of the drain 112, source 110 and semiconductor 108. The transistor 102 can be made from organic materials such as pentacene, or inorganic materials, such as amorphous silicon.

The integration of the transistor 102 with the field emitter structure 12 may be achieved in a number of ways. For example, it may be possible to create a transistor backplane using lithographic or non-lithographic means. A conducting gate layer 104 could be deposited first to form gate 104, followed by the insulating layer 106. The semiconductor 108 could be deposited next, followed by metallization for the source electrode 110 and drain electrode 112. The transistor structure 102 could then be coated in an insulating layer, etched to form a via on the drain contact, and additional metal could be deposited. The field emitter structure 12 could then be formed in the usual way on this structure.

Any of a number of insulators appropriate to the semiconductor and conducting layers used may be employed.

Examples include plasma-enhanced CVD oxides and nitrides, organic spin-on layers such as PMMA or PVA, physical vapor deposited insulators such as sputtered or e-beam alumina, silicon dioxide, silicon nitride, and so forth, or vapor deposited organic materials such as parylene.

Only one transistor is shown in the figure. In a display application, typically one transistor per pixel is used. It will be appreciated, however, that additional transistors may be to provided to each pixel to hold the image on the display panel. The backplane could have wiring arranged to contact the gate and source terminals of multiple transistors, possibly for use in a matrix arrangement.

Figure 8:
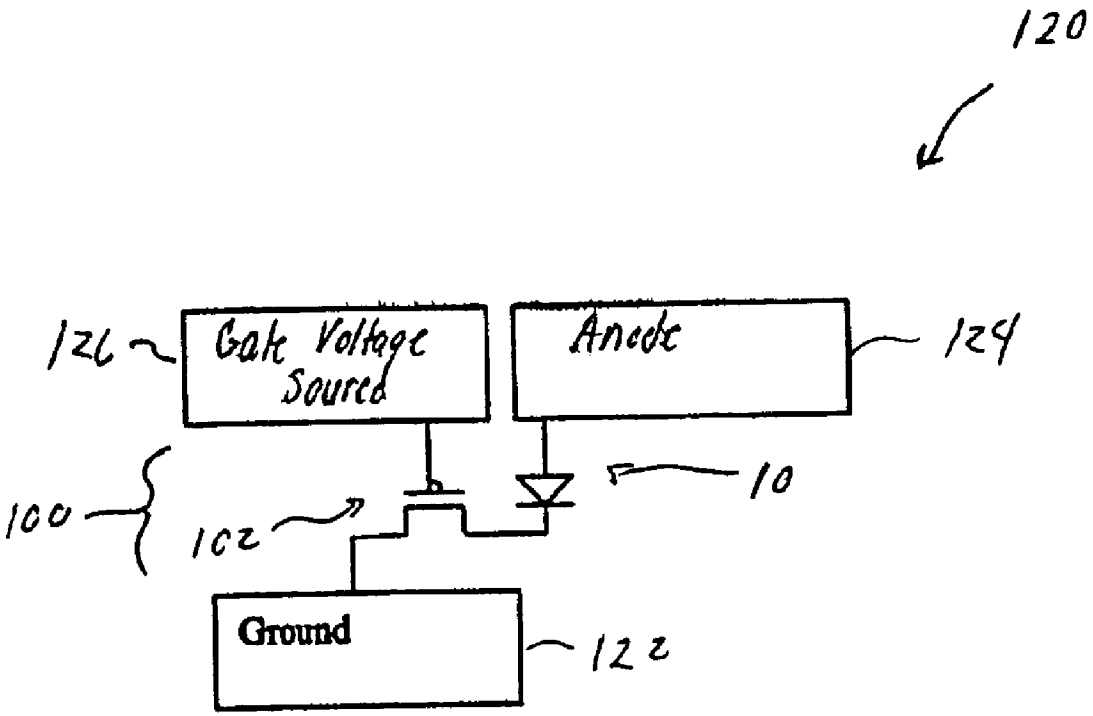
FIG. 8 is a circuit diagram of a system that includes the organic field emission device shown in FIG. 7.

Referring to FIG. 8, shown schematically, in a system 120 that includes the device 100, the field emission device 10 and the transistor 102 are connected in series. The transistor 102 is also connected to ground 122 and the device 10 is connected to an anode 124 which provides a high positive voltage source. A gate voltage source 126 provides a small negative voltage to the gate of the transistor 102.

Thus, referring to FIGS. 7 and 8, in such a configuration, the supply of electrons from the field emitter structure 12 of the device 10 to, for example, a light emitting source (as in a display) is controlled by the channel accumulation layer, which depends on the gate voltage. This type of control reduces the threshold and voltage swings required to turn the field emission current on and off, thus eliminating the need for a close proximity gate and reducing the temporal and spatial variation of current.

Replacing the annular gated structure (as described above with reference to FIG. 6) with an integrated transistor eliminates the complicated type of processing needed to achieve the annular gated structure. Also, in display applications, the use of the transistor for gated control means that all of the control circuitry can be placed on the backplane, allowing the front glass to be a simple common electrode with phosphors.

Reduction in current noise is particularly significant when using the integrated transistor arrangement. Emission from field emission tips is noisy because of bombardment by gaseous ions which change the local field and reshape the micro-tip, causing a long-term drift of characteristics. The integrated transistor structure reduces emission current by limiting the supply of carriers through the transistor.

Thus, for device 100, the field emitter structures 12 (with micro-tips 16) are gated through integration with the transistor 102, which allows a low voltage turn-on, less noise and increased stability. This arrangement allows for high performance in an all room temperature process gated (i.e., active matrix) field emission displays, with no complicated processing steps and the possibility for extremely low cost and integration with a wide variety of substrates.

All of the above-described approaches yield field emission micro-tips using organic materials while retaining simple and low cost processing. Nanometer scale structures may be formed without lithography, and no vacuum steps are needed.

Other advantages are derived from the use of organic materials as the conductor as well. For example, many organics are conductive when oxidized, so formation of an insulating oxide on the surface of the device may be avoided. Additionally, photopatterning and solvent based techniques may be used to pattern devices after deposition and to form gate structures from other conductors. Still further, thermoplastic polymers may be used as the conductor, the matrix, or both (in matrix-less systems). This allows types of processing not previously available (such as nanoimprint lithography) to be used, and also allows for tip sharpening during operation through reduced viscosity of the matrix. Organic materials can also be made resistant to sputtering. Sputter damage may be reduced by selecting appropriate organic matrices. These properties can help make micro-tips which are resistant to typical FEA degradation mechanisms and might even be self-healing. The patterned materials have a low emission threshold. In addition, organic conductors may be deposited and processed at or near room temperature, which allows the use of a greater range of substrates and layers integrated into the substrate, including low-cost polymeric substrates and materials.

Figure 9:
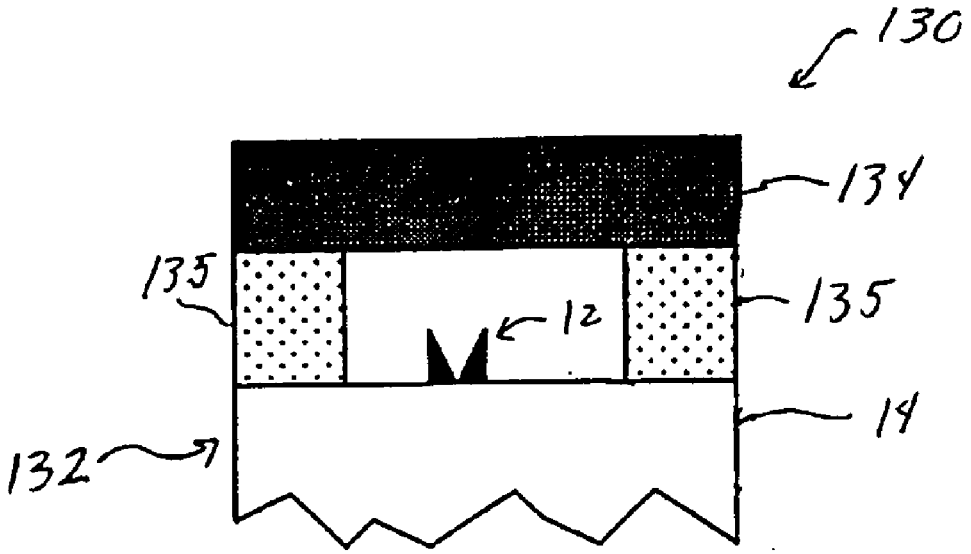
FIG. 9 is a cross-sectional view of an exemplary field emission display that employs the organic field emission device.

As was mentioned earlier, in one possible application, the organic field emission device serves as an electron source in a cathode of a field emission display (FED). Referring to FIG. 9, an exemplary FED 130 that employs the organic field emitter structure 12 is shown. The FED 130 includes a cathode 132, which includes the substrate 14 and one or more field emitter structures 12. Thus, the substrate 14 and structure 12 (the bottom electrode) collectively form the organic field emission device 10. Also included in the FED 130 is an anode (or top electrode) 134, which typically includes a layer of light emitting (or fluorescent) material, such as a phosphor layer, an indium tin oxide (ITO) conducting layer and a substrate. The anode 134 and the cathode 132 are separated by one or more spacers 135.

Figure 10:
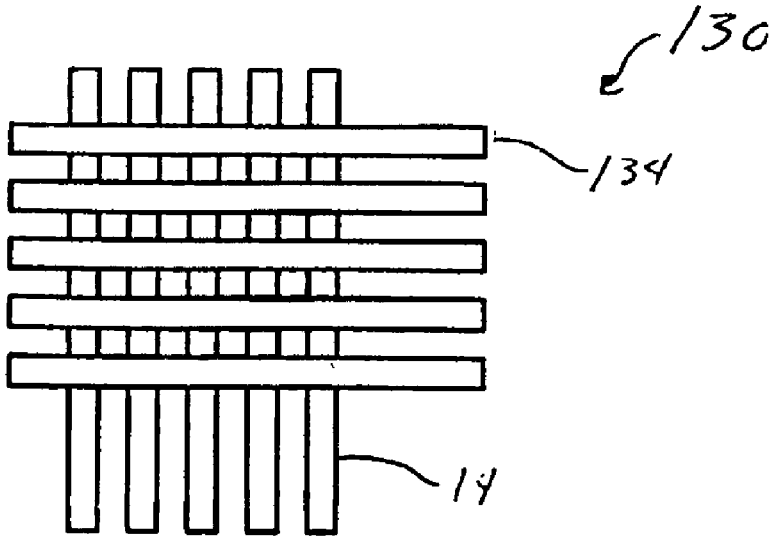
FIG. 10 is a planar view of the field emission display shown in FIG. 9.

FIG. 10 shows a planar view of the FED 130 in a passive matrix architecture. The passive matrix includes the patterned bottom electrodes (substrate 14 with structure 12) and the patterned top electrodes 134.

Figure 11:
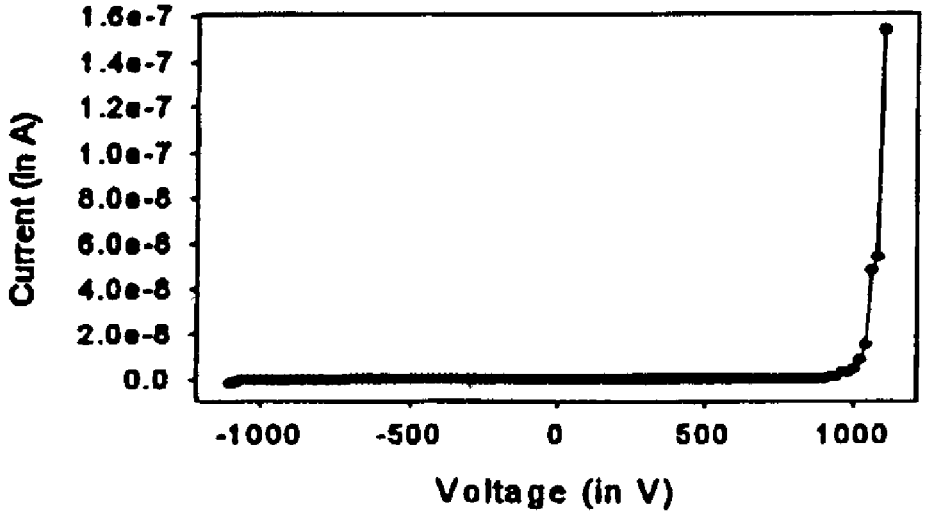
FIG. 11 is a linear-linear I-V plot of the organic field emission device in a diode configuration.
Figure 12:
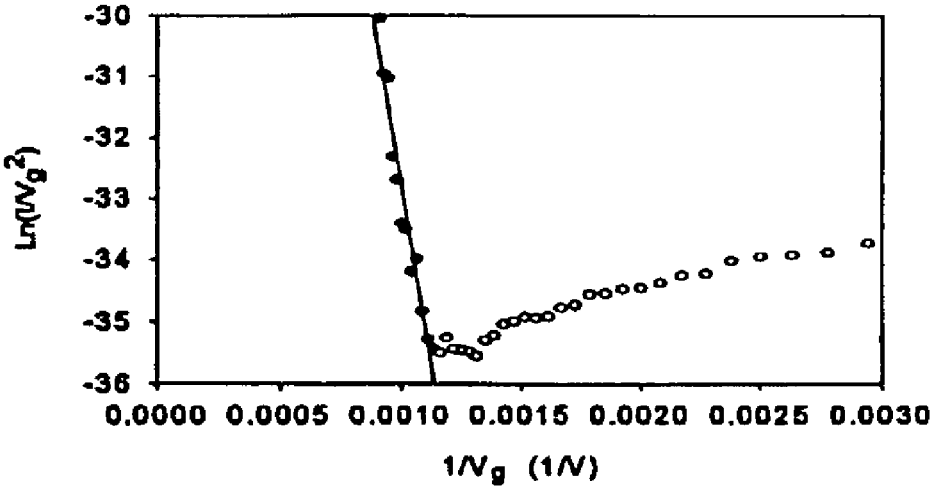
FIG. 12 is a Fowler-Nordheim plot of data from the organic field emission device in a diode configuration.

FIGS. 11 and 12 show characteristics of the organic field emission device under test in a vacuum test system in a diode configuration with a 50 micron gap between anode and cathode. FIG. 11 is a linear-linear IV plot. The plot shows the excellent turn-on characteristics and rectification characteristics of the field emitter micro-tips. According to the data, the device shows a field enhancement of about 500, and an on/off ratio of over 1000. FIG. 12 is a plot of data from the field emission device in the Fowler-Nordheim coordinates. Given a work function of 5 eV for polypyrrole, one would obtain from the plot a slope of −23100, which corresponds to a field enhancement of approximately 500 times.

Figure 13:
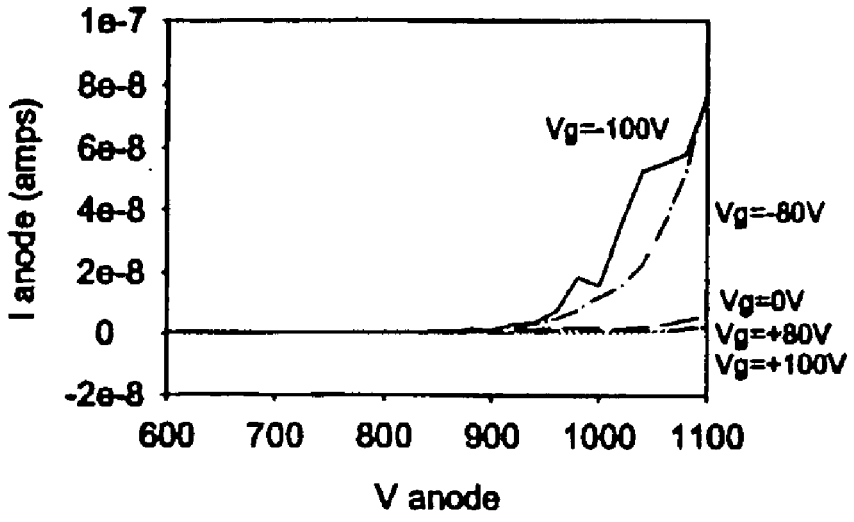
FIG. 13 is an I-V plot of the organic field emission device with integrated transistor for different transistor gate voltages.
Figure 14:
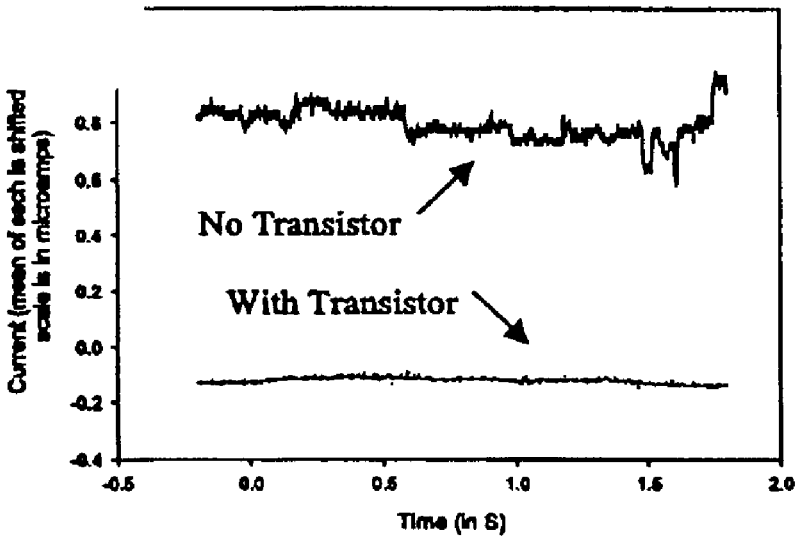
FIG. 14 is a plot of current as a function of time for an organic field emission device with and without the integrated transistor.

FIGS. 13 and 14 show characteristics of the organic field emission device with integrated organic transistor, again in a vacuum test system. As indicated above, the transistor controls the output of the field emission device. The transistor acts as a current source and regulates the emission current by feeding back on the voltage on the micro-tip.

FIG. 13 shows a plot of I-V gate voltage curves for different gate voltages applied to the gate of the transistor. The curves show the control that the transistor gate has on the emitter current. The device's output may be controlled with a relatively small change in the gate voltage. This change can be reduced further by adjusting the gate dielectric so that the transistor can be turned on and off with an even smaller swing. FIG. 14 is a plot of current as a function of time for the field emission device with and without the integrated transistor. The plot shows the reduction in the amount of noise (from 55 nA=32% to 10 nA=13% standard deviation) with the introduction of a transistor in series (which acts as a low-noise current source). The plot shows the deviation on a scale of microamps. It will be noted that the average current is lower when the transistor is used because of the voltage drop across the transistor. Thus, a significant reduction in the noise is achieved by limiting the supply of carriers to the emission device instead of relying on the transmission through the surface barrier (which is noisy).

Other processes are contemplated, including the use of photolithography (with a mask or self-aligned) or other combinations of mechanical and chemical patterning techniques. Other techniques can use organic solvent-borne material systems (such as polyaniline in m-cresole with camphorsulfonic acid dopants and a polymethylmethacrylate matrix), as well as matrix free systems (such as polyaniline and polythiophine). Direct polymerization onto the substrate or a template may be envisioned. Patterning using templates, photolithography, nanoindentation lithography, lithographically induced self alignment (LISA), lithographically induced self-assembly (LISC), self assembly by blending with segregating materials, polymerization into templates, or selective etching of the matrix in which the materials are dispersed are all also alternative possibilities for fabrication of this type of device. Still other techniques include: electrospinning; LISA/LISC; hot press embossing; direct lithography; interferometric lithography; block copolymer segregation; electropolymerization without template; and electropolymerization onto catalyst or electrode islands.

It will be appreciated that the field emitter structure formed by these processes may differ in shape from the structure 12 produced by the process 20 of FIG. 2 while still providing significant field enhancement. For example, the field emitter structure 12 can be any type of raised structure, for example, a raised structure that has a spherical-shaped surface, or one or more points, ridges or edges through which electrons are emitted.

Figure 15A:
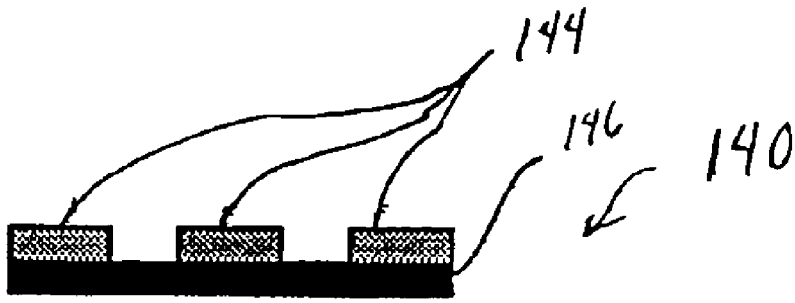
FIGS. 15A–15B are cross-sectional diagrams depicting fabrication of an organic field emission device by electropolymerization.
Figure 15B:
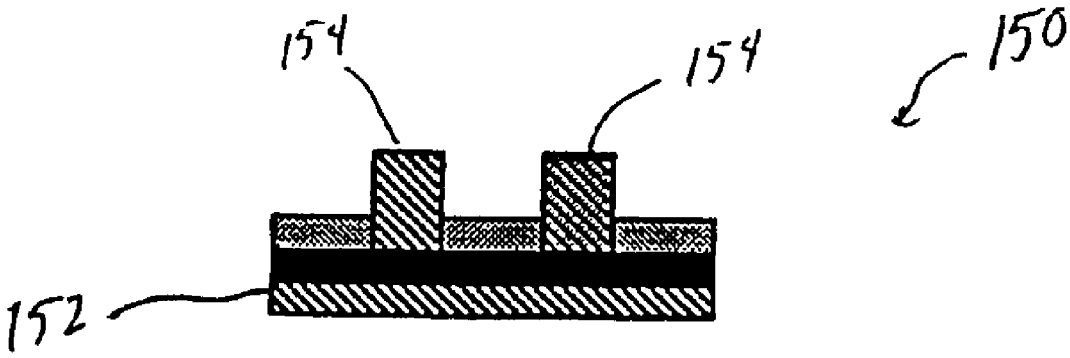

For example, and referring to FIGS. 15A–15B, a device with organic field emitters (or field emitter structures) can be fabricated by electropolymerization. First, as shown in FIG. 15A, a structure 140 is formed by coating a membrane 144 with an organic conductor material 146. Referring to FIG. 15B, the structure 140 is processed to produce a second structure 150 by placing the coated membrane into a bath of monomers 152 and applying a potential, thus polymerizing the organic material to form organic field emitters 154 in the membrane pores. The resulting structures 154 may be tube-shaped.

Possible organic materials that can be used for the conductor and matrix are many. A great number of functional properties may be pursued (such as physical photopatterning or photopatterning of conductive areas, heat conversion to insoluble forms, etc.). The PVA system described above, for example, may be cross-polymerized to harden it prior to subsequent steps using chemicals, light and a photoinitiator, or the application of heat. Solvent selective processing may also be used in subsequent processing (such as for dissolving the polycarbonate template or depositing an insulator) since PVA is insoluble in many non-polar solvents and insoluble in water after cross-polymerization. A number of other matrix and conductor materials may be selected to fit the process used. Matrix materials can include the following: polycarbonate; polymethylmethacrylate; polyvinyl alcohol; polyvinyl acetate; as well as polystyrenes or polyimides. Conductors can include materials such as alkyl-polythiophenes, polyaniline, polypyrroles or polyphenylenevinylines. The latter may be doped and/or stabilized with a number of additives including the following: halogens (such as iodine) or halogen donating materials; organic acids (such as camphorsulfonic acid); inorganic acids (such as sulfuric acid); and surfactant materials or solvents (such as meta-cresole).

Other possible material systems include the following: Poly(alkyl-thiophene) derivatives; Poly(phenylene)/Poly(phenylene vinylele)/Poly(phenylene sulfide)/Poly(phenylene oxide)/Poly(phenylene chalcogenide); Polyacetylene/Poly(diacetylene); Poly(azulenes); Poly(quinolines); Poly(diphenylamine); and Poly(acenes). Also, ladder polymer combinations include poly(p-phenylene-2,6-benzobisoxazolediyl) (PBO) and poly{7-oxo-, 10H-benz[de]imidiazo[4',5':5,6]-benzimidiazo[2,1-a]isoquinoline-3,4:10,11-tetrayl)-10-carbonyl} (BBL).

Therefore, through selection of materials and designs as discussed above, simple, room temperature processes can be used to achieve field emission with active, gated control and low noise. In particular, such simple processes show great promise for display architectures.

Other embodiments are within the scope of the claims.

What is claimed is:

1. A field emission device of comprising a conductor having a plurality of micro-tips, the micro-tips comprising an organic material wherein the organic material comprises, a polyvinyl alcohol/polypyrrole doped conducting composite patterned using a polycarbonate filter membrane.

2. The field emission device of claim 1 wherein a gated electrode structure is disposed above the micro-tips.

3. The field emission device of claim 1 wherein the field emission device further comprises a transistor integrated therein, and wherein the conductor is connected in series with the transistor.

4. The field emission device of claim 3 wherein the transistor is an organic thin film transistor.

5. A field emission device comprising:

a substrate;

a conductor disposed above the substrate and comprising a raised structure wherein the raised structure comprises an organic material comprising a polyvinyl alcohol/polypyrrole doped conducting composite.

6. A field emission display of comprising:

an anode comprising a light emitting material; and a cathode coupled to the anode comprising:

a substrate; and a plurality of organic field emitters disposed on the substrate wherein the organic field emitters comprise a polyvinyl alcohol/polypyrrole doped conducting composite.

7. The field emission display of claim 6 wherein the composite is patterned using a polycarbonate filter membrane.

8. The field emission display of claim 6 wherein the organic field emitters are gated structures.

9. The field emission display of claim 5 wherein the composite is patterned using a polycarbonate filter membrane.

* * * * *

UNITED STATES PATENT AND TRADEMARK OFFICE

CERTIFICATE OF CORRECTION

PATENT NO. : 6,870,312 B1
DATED : March 22, 2005
INVENTOR(S) : Ioannis Kymissis et al.

It is certified that error appears in the above-identified patent and that said Letters Patent is hereby corrected as shown below:

Column 1,
Line 1, insert the following:
-- STATEMENT REGARDING FEDERALLY SPONSORED RESEARCH
This invention was made with government support under Grant Number ECS-9624233, awarded by NSF. The government has certain rights in the invention. --.

Column 4,
Line 18, delete "insulator (or" and replace with -- insulator or --.
Line 42, delete "oh the substrate" and replace with -- on the substrate --.

Column 5,
Lines 8-9, delete "may be to provided" and replace with -- may be provided --.

Column 8,
Line 26, delete "comprises," and replace with -- comprises: --.

Signed and Sealed this

Thirtieth Day of May, 2006

JON W. DUDAS
*Director of the United States Patent and Trademark Office*